United States Patent [19]

Mohr

[11] Patent Number: 5,031,842

[45] Date of Patent: Jul. 16, 1991

[54] OUTBOARD MOTOR SUPPORT STRUT

[75] Inventor: Jeffrey S. Mohr, Minneapolis, Minn.

[73] Assignee: Scott G. Peterson, Tonka Bay, Minn. ; a part interest

[21] Appl. No.: 528,813

[22] Filed: May 25, 1990

[51] Int. Cl.[5] ..... F16M 13/00

[52] U.S. Cl. ..... 248/640; 248/351; 440/900

[58] Field of Search ..... 248/640, 642, 351, 354.1; 114/187, 188; 440/900

[56] References Cited

U.S. PATENT DOCUMENTS

| | | | |
|---|---|---|---|
| 2,782,052 | 2/1957 | Albrecht et al. | 248/640 X |
| 2,977,084 | 3/1961 | Brown et al. | 248/642 |
| 3,941,344 | 3/1976 | Paterson | 248/642 X |
| 4,331,431 | 5/1982 | Estes | 248/642 X |
| 4,501,561 | 2/1985 | Speelman | 248/640 X |
| 4,650,427 | 3/1987 | Huchinson | 248/642 X |
| 4,685,888 | 8/1987 | Brewer | 248/642 X |
| 4,828,186 | 5/1989 | Weiss | 248/640 |
| 4,842,239 | 6/1989 | Kinsey et al. | 440/900 X |

*Primary Examiner*—David L. Talbott

*Attorney, Agent, or Firm*—John W. Adams

[57] ABSTRACT

An adjustable motor support strut extending between the lower unit of an outboard motor and the drain hole in the transom of the boat, with a pivoted support member insertable into the drain hole and a Y-shaped cradle element at the top of the strut member adapted to receive an intermediate portion of the lower unit of the motor mounted on the transom.

4 Claims, 1 Drawing Sheet

OUTBOARD MOTOR SUPPORT STRUT

BACKGROUND OF THE INVENTION

This invention relates to strut unit for supporting the weight of the lower unit of an outboard motor mounted on the transom of a boat. Outboard motors have a tilt mounting on the boat transom. The cantilevered weight of the motor produces problems which include damaging the transom portion of the boat as well as the motor. A number of devices have been patented in attempts to alleviate these problems, e.g.:

| U.S. Pat. No. | INVENTOR | ISSUED | TITLE |
|---|---|---|---|
| 2,901,267 | C. H. Holsclaw | 8/25/59 | OUTBOARD MOTOR SUPPORT |
| 2,977,084 | D. G. Brown et al | 3/28/61 | OUTBOARD MOTOR TILT-UP RACK |
| 3,941,344 | Paterson | 3/2/76 | MOTOR SUPPORT |
| 4,501,561 | Speelman | 2/26/85 | BRACE DEVICE FOR MOTOR BOAT DRIVE UNIT |
| 4,650,427 | Huchinson | 3/17/87 | SPRING ACTION BOAT MOTOR SUPPORT |
| 4,842,237 | Kinsey et al | 6/27/89 | OUTBOARD BOAT MOTOR SUPPORT DEVICE |

However, these devices do not have the ease of attaching the support device to the transom and transferring the stress to the bottom of the transom by mounting the lower end of the strut in the drain hole of the boat. The above identified patents represent the closest prior art known to inventor at the time of filing this application.

SUMMARY OF THE INVENTION

The present apparatus supports the lower unit of a boat motor in tilt position on a boat mounted on a trailer. The apparatus adjusts so that it may be used on different sized motors and boats. The upper end of the strut is a Y-shaped motor-engaging cradle. The lower end of the support apparatus is inserted directly into the drain hole located at the bottom of the transom to transfer the weight and shock of the motor to the bottom of the transom adjacent the bed of the trailer on which the boat and motor unit is mounted.

DETAILED DESCRIPTION OF THE DRAWINGS

DETAILED DESCRIPTION OF THE PREFERRED EMBODIMENT

Figure 1:
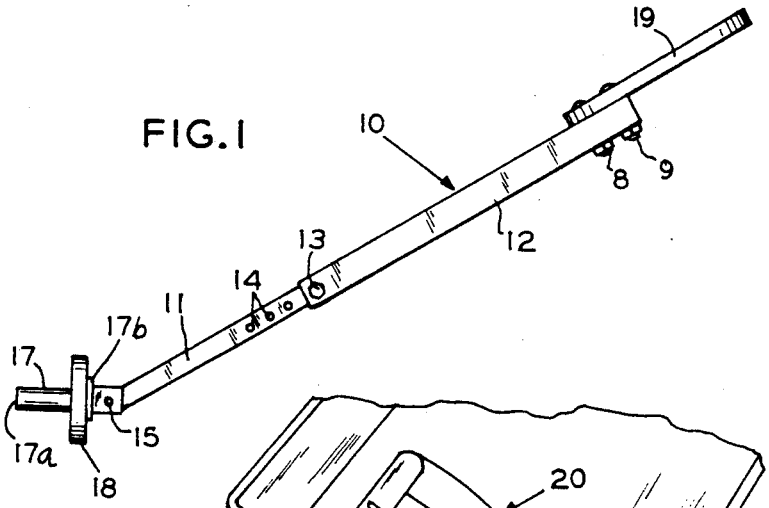
FIG. 1 is an elevational side view of the strut unit.
Figure 2:
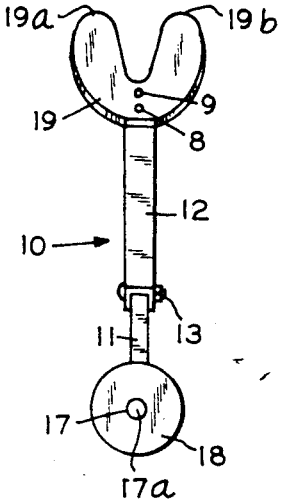
FIG. 2 is a front view of the strut unit.
Figure 3:
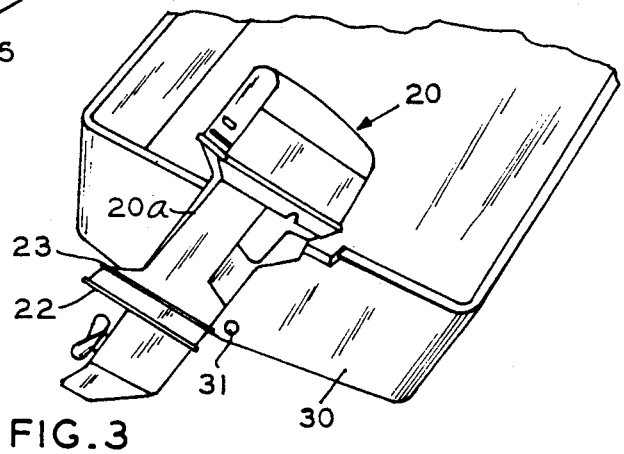
FIG. 3 is a perspective view of an outboard motor mounted on the transom of a boat.

The support strut 10 is best shown separately in non-operative position in FIGS. 1 and 2. The main body of the strut 10 is constructed from suitable material such as stainless steel. The strut 10 is formed by two adjustably telescoping sections, a lower section 11 and upper section 12 with an anchoring bolt 13 to adjustably connect the sections. This construction allows the length of the strut to be adjusted to fit different sized motors. A typical outboard motor 20 is illustrated. The two strut sections 11 and 12 may be adjusted by providing a plurality of spaced apart holes 14 in the lower strut element 12 which selectively receive the anchoring bolt 13 to produce the desired adjusted strut length.

A bottom support member 17 is pivotally connected to the lower end of lower strut section 11 and is insertable into the drain hole 31 provided at the bottom of the transom 30 of the boat. In the form shown, a pivot joint 15 connects bottom support member 17 and the lower end of lower strut section 11. A donut-shaped cushioning stop member 18, made from suitable resilient cushioning material such as nylon, surrounds the bottom support member 17 and is positioned in spaced relation to the free end 17*a* of the member 17 to permit insertion of the free end 17*a* into the drain hole 31 in the transom, with the member 18 engaging the portion of the transom which surrounds the drain hole 31. A stop collar 17*b* is fixed to member 17 between the pivot joint 15 and the cushioning member 18 to provide the desired insertion length of the free end 17*a* into the drain hole 31.

A motor engaging Y-shaped cradle 19 is attached to the upper end of the upper motor support section 12 and receives the lower unit 20*a* between flanges 22 and 23 conventionally incorporated on the lower unit 20*a* of an outboard motor 20, as shown. The Y-shaped cradle 19 may be made from a resilient non-scratching supporting material, such as nylon, to support and protect the engaged portion of the lower unit of the motor 20. The arms 19*a* and 19*b* of the Y-shaped cradle 19 receive the lower unit 20*a* of the motor between the flanges 22 and 23 of the lower unit, when the motor is in the desired raised position. An attachment portion 12*a* of the upper section 12 is flattened to facilitate making a fixed connection between the cradle 19 and the upper section 12. Suitable bolts 8 and 9 are provided for connecting the upper section 12 and the lower portion of cradle 19.

Figure 4:
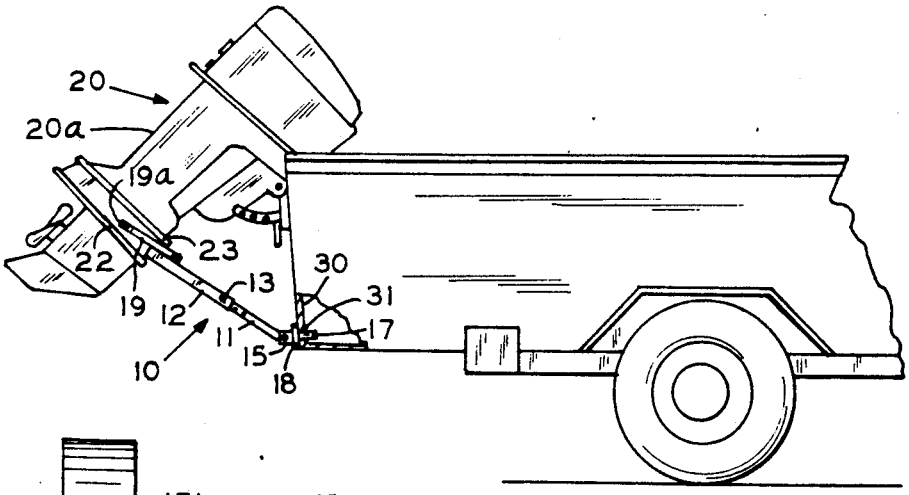
FIG. 4 is an elevational view of the motor, boat and trailer with the strut unit in operative position.
Figure 5:
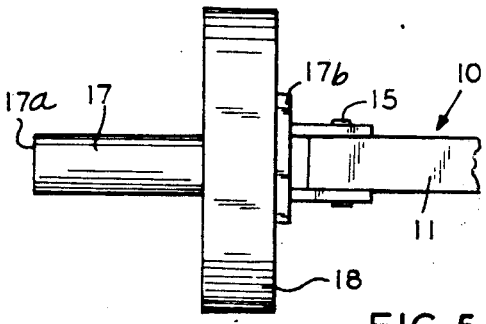
FIG. 5 is a side view of the stop collar.

An appropriate method for positioning the strut 10 in its support position, as illustrated in FIG. 4, is described below. The strut 10 is adjusted to fit the particular sized motor 20 and boat combination being transported. In the specific construction disclosed, the adjustment is made by telescopically positioning the upper section 12 within the lower section 11 and locking the two sections together with bolt 13, as described above. The strut should be adjusted so that the cantilever bending stress produced by the weight of the motor on the upper portion of the transom 30 is transferred directly to the bottom portion of the transom adjacent the bottom structural system of the boat. Once the strut 10 is adjusted to receive the raised lower unit of the motor 20. The free end 17*a* of the bottom member 17 is inserted into the drain hole 31 and the lower unit 20*a* of the motor 20 is received in the support cradle 19 which is positioned between flanges 22 and 23 of the lower unit. The stress of the weight of the motor will be distributed to the bottom structural system of the boat adjacent the bottom of the transom and the bed of the trailer unit.

It will of course, be understood that various changes may be made in the form, details, arrangement and proportions of the parts herein described without departing from the scope of the invention which is set forth generally in the appended claims.

What is claimed is:

1. Apparatus for supporting the lower unit of an outboard boat motor mounted on the transom of a boat which is transported on a trailer, comprising, a supporting strut member extending between an intermediate portion of a raised lower unit of a boat motor and the drain hole at the bottom of the transom of the boat, a lower support member specificly constructed to be inserted into a drain hole located at the bottom of the boat transom, a supporting element at the upper end of said strut member to engage a portion of the lower unit of a boat motor, and means for adjusting the length of the strut member to permit said strut to be used for different sized motors.

2. The structure set forth in claim 1 wherein the lower support member is pivotally mounted on the lower portion of the strut member.

3. The structure set forth in claim 1 and a cushioning stop element surrounding the lower support member for engaging a substantial annular area of the transom surrounding the drain hole to distribute the weight of the motor to the lower portion of the transom around the drain hole.

4. The structure set forth in claim 1 wherein said supporting element is a Y-shaped cradle element made from cushioning material.

* * * * *